US008668268B1

(12) United States Patent
Cormack

(10) Patent No.: US 8,668,268 B1
(45) Date of Patent: Mar. 11, 2014

(54) LOUNGE CHAIR ASSEMBLY

(76) Inventor: Stephen J. Cormack, Utopia (CA)

( * ) Notice: Subject to any disclaimer, the term of this patent is extended or adjusted under 35 U.S.C. 154(b) by 16 days.

(21) Appl. No.: 13/463,272

(22) Filed: May 3, 2012

(51) Int. Cl.
*A47C 7/00* (2006.01)
*A47C 17/00* (2006.01)

(52) U.S. Cl.
USPC ..... 297/354.13; 297/377; 297/900

(58) Field of Classification Search
USPC ..... 297/900, 410, 188.08, 354.13, 188.13, 297/377; 5/110, 111, 631, 930
See application file for complete search history.

(56) References Cited

U.S. PATENT DOCUMENTS

| | | | | |
|---|---|---|---|---|
| 4,606,086 | A | 8/1986 | Rowland | |
| 4,941,222 | A | 7/1990 | Prager | |
| 5,326,152 | A * | 7/1994 | Baron | 297/229 |
| 5,556,166 | A * | 9/1996 | Synnestvedt | 297/377 |
| 5,624,157 | A * | 4/1997 | Kostuk | 297/228.13 |
| D400,722 | S | 11/1998 | Luther | |
| 5,946,749 | A | 9/1999 | Sewell | |
| 5,950,259 | A * | 9/1999 | Boggs | 5/111 |
| 6,059,365 | A * | 5/2000 | Diamond | 297/354.13 |
| 6,588,034 | B2 | 7/2003 | Nation | |
| 6,755,463 | B2 * | 6/2004 | Lardieri et al. | 297/35 |
| 6,854,807 | B2 * | 2/2005 | D'Alessandro | 297/354.13 |
| 7,661,163 | B1 | 2/2010 | Gallaher | |

* cited by examiner

*Primary Examiner* — Milton Nelson, Jr.

(57) ABSTRACT

A lounge chair assembly includes a frame having a top section, a bottom section, and a medial section. A support member is coupled to the frame for supporting a person on the frame. The support member has a corresponding top portion, bottom portion, and medial portion coupled to the frame. A plurality of legs is coupled to the frame. A telescopic headrest extends from the top section of the frame. An aperture extends through the head rest. A pair of openings extend through the bottom portion of the support member. Each opening is configured for receiving a human foot therethrough whereby a leg extending from the foot is abutted and supported by the support member without bending of the foot relative to the leg.

16 Claims, 4 Drawing Sheets

LOUNGE CHAIR ASSEMBLY

BACKGROUND OF THE DISCLOSURE

1. Field of the Disclosure

The disclosure relates to chair devices and more particularly pertains to a new chair device for facilitating comfortable rest and relaxation for a user.

2. Summary of the Disclosure

An embodiment of the disclosure meets the needs presented above by generally comprising a frame having a top section, a bottom section, and a medial section coupled to and extending between the top section and the bottom section. A support member is coupled to the frame and configured for supporting a person on the frame. The support member has a top portion coupled to the top section of the frame, a bottom portion coupled to the bottom section of the frame, and a medial portion coupled to the medial section of the frame. A plurality of legs is coupled to the frame. A headrest is telescopically coupled to the frame extending from the top section of the frame. An aperture extending through the head rest. A pair of openings extend through the bottom portion of the support member. Each opening is configured for receiving a human foot therethrough whereby a leg extending from the foot is abutted and supported by the support member without bending of the foot relative to the leg.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
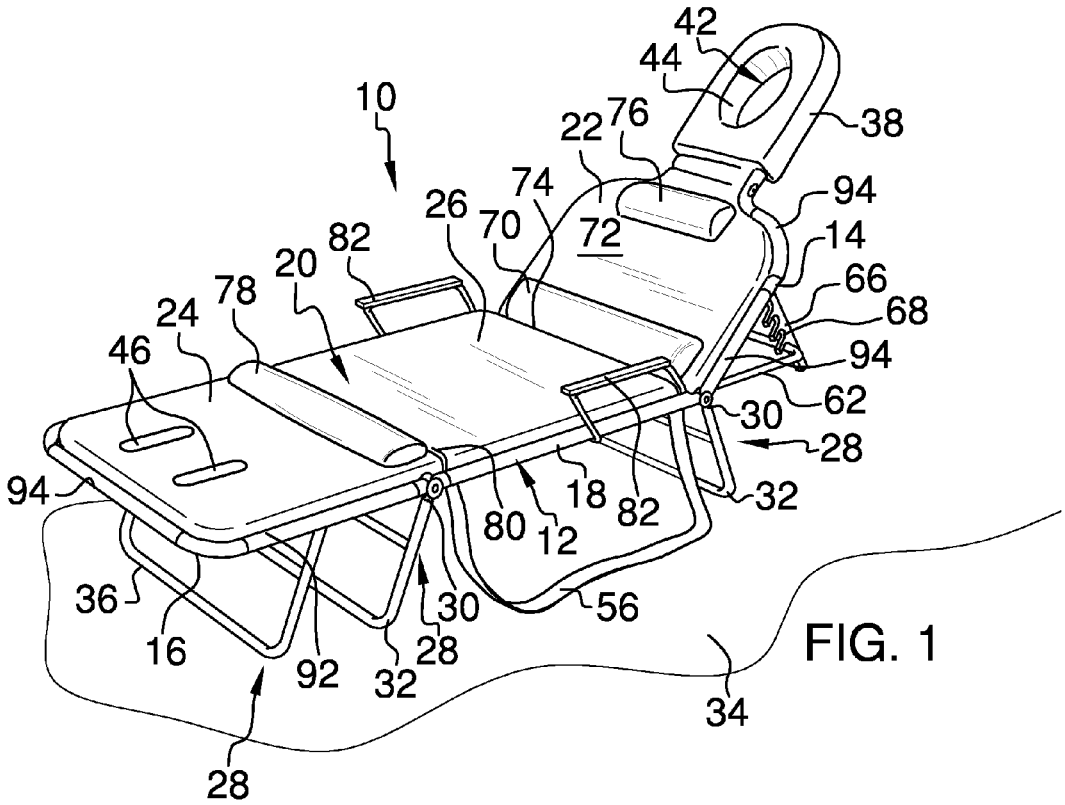
FIG. 1 is a top front side perspective view of a lounge chair assembly according to an embodiment of the disclosure.
Figure 2:
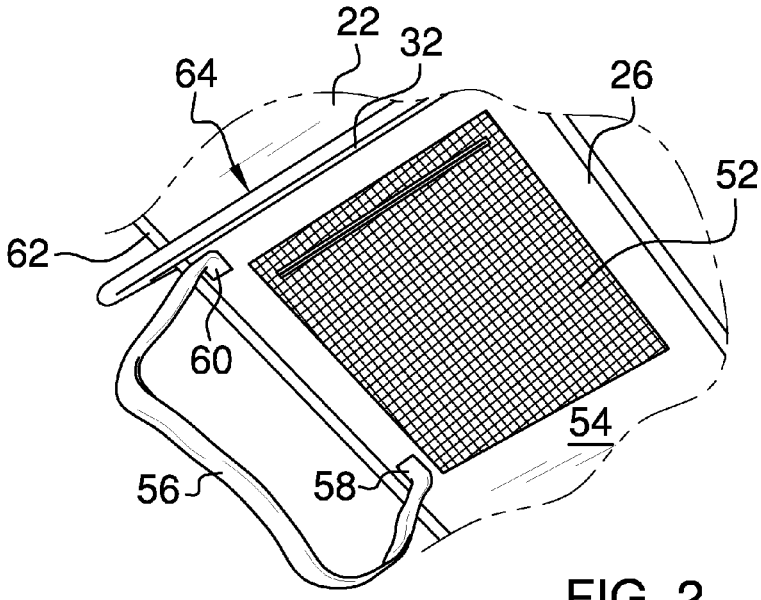
FIG. 2 is a partial bottom side rear perspective view of an embodiment of the disclosure.
Figure 3:
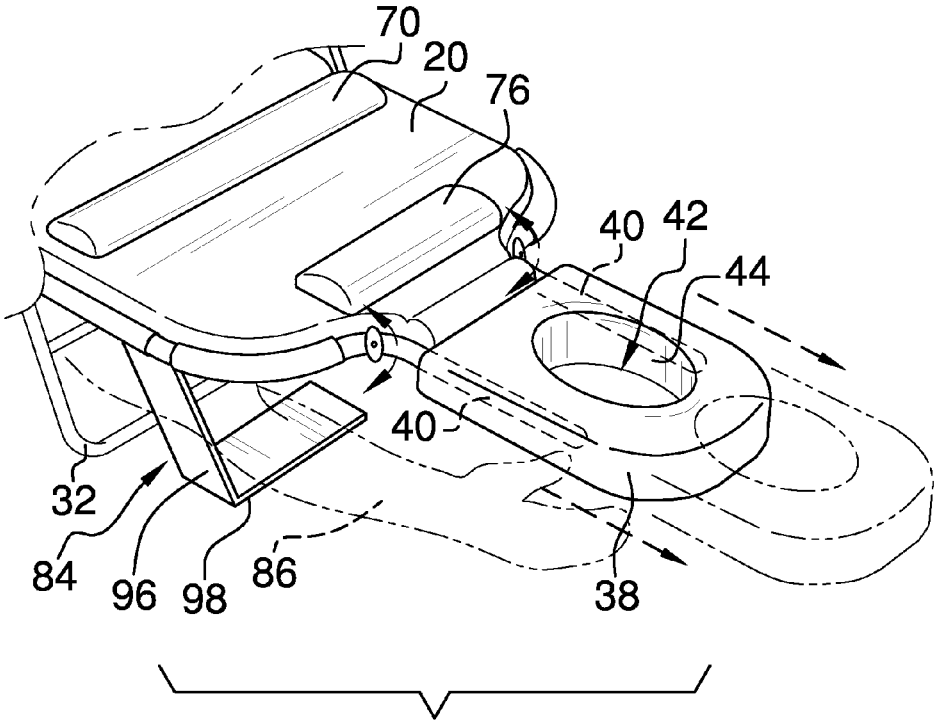
FIG. 3 is a partial top rear side perspective view of an embodiment of the disclosure.

With reference now to the drawings, and in particular to FIGS. 1 through 7 thereof, a new chair device embodying the principles and concepts of an embodiment of the disclosure and generally designated by the reference numeral 10 will be described.

As best illustrated in FIGS. 1 through 7, the lounge chair assembly 10 generally comprises a frame 12 having a top section 14, a bottom section 16, and a medial section 18 pivotally coupled to and extending between the top section 14 and the bottom section 16. A support member 20 is coupled to the frame 12. The support member 20 may be formed or a padded material, a wrapped strand of material, a sheet of material, or the like as is conventionally known in the construction of lounge chairs. The support member 20 is configured for supporting a person on the frame 12. The support member 20 has a top portion 22 coupled to the top section 14 of the frame 12, a bottom portion 24 coupled to the bottom section 16 of the frame 12, and a medial portion 26 coupled to the medial section 18 of the frame 12. The support member 20 may be coextensive with the frame 12 and attached at a perimeter edge 92 of the support member 20 using loops 94.

A plurality of legs 28 is coupled to the frame 12. Each leg 28 may be U-shaped having opposite ends 30 coupled to the frame 12. The plurality of legs 28 includes a pair of main legs 32 pivotally coupled to the medial section 18 of the frame 12. The main legs 32 are configured for supporting the medial section 18 of the frame 12 over a support surface 34. The plurality of legs 28 also includes a supplemental leg 36 pivotally coupled to the bottom section 16 of the frame 12. The supplemental leg 36 selectively supports the bottom section 16 of the frame 12 over the support surface 34. The supplemental leg 36 may also be pivoted to prevent support of the bottom section 16 to permit the bottom section 16 and bottom portion 24 of the support member 20 to hang down from the medial section 18 of the frame 12.

A headrest 38 is telescopically coupled to the frame 12 such that the headrest 38 extends from the top section 14 of the frame 12. The frame 12 may include a pair of spaced prongs 40 extending from the top section 14 of the frame 12. The prongs 40 may be slidably inserted into the headrest 38 to permit adjustment of a distance between the headrest 38 and the top section 14 of the frame 12. The prongs 40 may also be hingedly coupled to the frame 12 to permit angling of the headrest 38 relative to the top section 14 of the frame 12. An aperture 42 extends through the head rest 38. The aperture 42 is defined by an edge 44 configured for positioning around a face of a person lying face down on the support member 20 such that the headrest 38 provides support without obstruction of the eyes, nose or mouth of the person lying on the support member 20.

A pair of openings 46 extends through the bottom portion 24 of the support member 20. Each opening 46 is configured for receiving a portion of a human foot 48 therethrough whereby a leg 50 extending from the foot 48 is abutted and supported by the support member 20 without bending of the foot 48 relative to the leg 50.

A pocket 52 may be coupled to a bottom surface 54 of the support member 20, more particularly coupled to the medial portion 26 of the support member 20 coupled to the medial section 18 of the frame 12. A strap 56 has a first end 58 coupled to the medial section 18 of the frame 12 and a second end 60 also coupled to the medial section 18 of the frame 12. The strap 56 is configured for facilitating carrying of the frame 12 when desired.

A frame extension 62 is coupled to and extends outwardly from a proximal edge 64 of the medial section 18 of the frame 12 relative to the top section 14. The frame extension 62 supports the top section 14 in a coplanar position 90 relative to the medial section 18 of the frame 12 when the top section 14 is in a fully reclined position. A bar 66 is pivotally coupled to the top section 14 of the frame 12. A plurality of hooks 68 is positioned along a length of the bar 66. Each hook 68 is selectively couplable to the frame extension 62 whereby the top section 14 is supported in a selectable graduated raised position relative to the medial section 18 of the frame 12.

A back pad 70 may removably coupled to an upper surface 72 of the support member 20 proximate a junction 74 between the top portion 22 of the support member 20 and the medial portion 26 of the support member 20 providing lumbar support as may be desired. The back pad 70 may be coupled to the support member 20 using hook and loop fastener engaged directly to the support member 20 or to a complimentary portion of hook and loop fastener coupled to the support member 20. Similarly, a neck pad 76 may be removably coupled to the upper surface 72 of the support member 20 positioned proximate the headrest 38. A leg pad 78 may also be removably coupled to the upper surface 72 of the support member 20. The leg pad 78 may be coupled to either the bottom portion 24 or the medial portion 26 of the support member 20 proximate a junction 80 between the bottom portion 24 of the support member 20 and the medial portion 26 of the support member 20.

Figure 4:
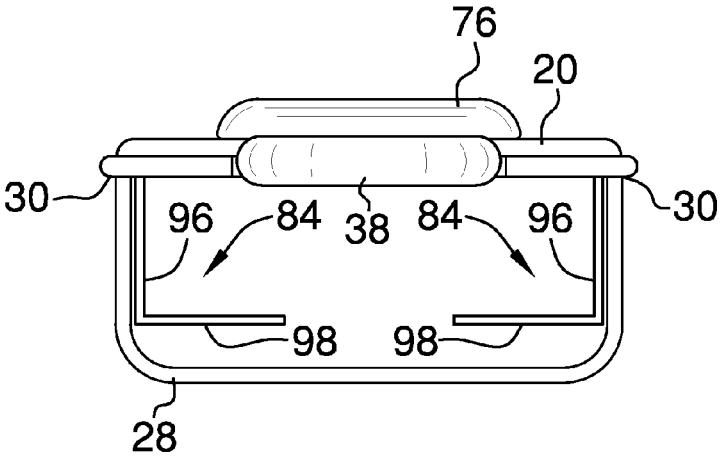
FIG. 4 is a rear view of an embodiment of the disclosure.
Figure 5:
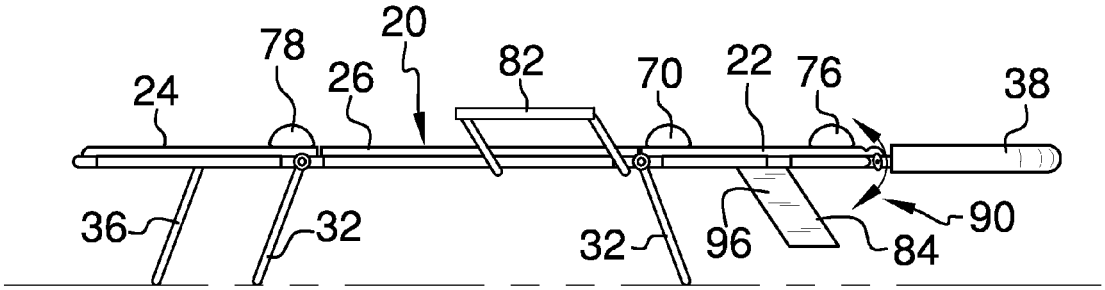
FIG. 5 is a side view of an embodiment of the disclosure.
Figure 6:
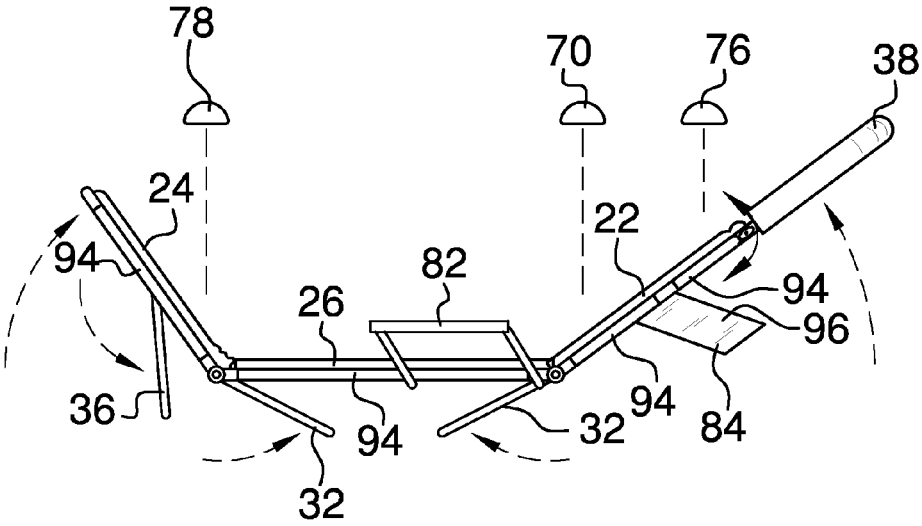
FIG. 6 is a side view of an embodiment of the disclosure.
Figure 7:
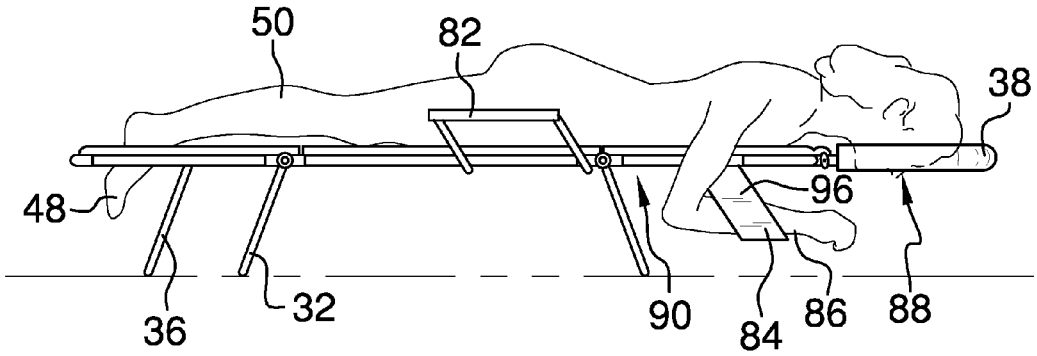
FIG. 7 is a side view of an embodiment of the disclosure.

A pair of upper arm rests 82 may be coupled to the medial section 18 of the frame 12. The upper arm rests 82 may be pivotally coupled such that they are collapsible and out of the way when not needed. A pair of generally L-shaped lower arm rests 84 may be coupled to and extend downwardly from the top section 14 of the frame 12. Each lower arm rest 84 includes a first section 96 and a section section 98 defining the L-shape as seen in FIG. 4. The first section 96 extends downwardly from the top section 14 of the frame 12 and forwardly towards the headrest 38 away from the medial section 18 of the frame 12 as seen in FIGS. 5 and 6. Thus, each lower arm rest 84 is configured for supporting a forearm 86 positioned on the lower arm rest 84 while a face 88 is positioned in the aperture 42 in the headrest 38.

In use, the legs 28 are deployed supporting the frame 12 and support member 20 in a desired configuration. A person may then lie on the support member 20, particularly in a face downward position in comfort. The back pad 70, neck pad 76 and leg pad 78 may be positioned as desired. When done, the person may fold the frame 12 up and collapse the legs 28. Storage is provided in the pocket 52 and the assembly 10 may be carried by the strap 56.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A lounge chair assembly comprising:

a frame having a top section, a bottom section, and a medial section coupled to and extending between said top section and said bottom section;

a support member coupled to said frame, said support member being configured for supporting a person on said frame, said support member having a top portion coupled to said top section of said frame, a bottom portion coupled to said bottom section of said frame, and a medial portion coupled to said medial section of said frame;

a plurality of legs coupled to said frame;

a headrest telescopically coupled to said frame, said headrest extending from said top section of said frame;

an aperture extending through said head rest;

a pair of openings extending through said bottom portion of said support member, said openings each being configured for receiving a human foot therethrough whereby a leg extending from the foot is abutted and supported by said support member without bending of the foot relative to the leg; and a pair of lower arm rests coupled to and extending downwardly from said top section of said frame and forwardly towards said headrest away from said medial section of said frame whereby each said lower arm rest is configured for supporting a forearm positioned on said lower arm rest while a face is positioned in said aperture in said headrest.

2. The assembly of claim 1, further including said plurality of legs having a pair of main legs pivotally coupled to said medial section of said frame, said main legs being configured for supporting said medial section of said frame over a support surface.

3. The assembly of claim 1, further including said plurality of legs having a supplemental leg pivotally coupled to said bottom section of said frame, said supplemental leg selectively supporting said bottom section of said frame over a support surface.

4. The assembly of claim 1, further including a strap coupled to said medial section of said frame.

5. The assembly of claim 1, further including upper arm rests coupled to said medial section of said frame.

6. The assembly of claim 1, further including a pocket coupled to a bottom surface of said support member.

7. The assembly of claim 6, further including said pocket being coupled to said medial portion of said support member coupled to said medial section of said frame.

8. The assembly of claim 1, further including a frame extension coupled to and extending outwardly from a proximal edge of said medial section of said frame relative to said top section, said frame extension supporting said top section in a coplanar position relative to said medial section of said frame.

9. The assembly of claim 8, further comprising:

a bar coupled to said top section of said frame; and a plurality of hooks positioned along a length of said bar, each said hook being selectively couplable to said frame extension whereby said top section is supported in a raised position relative to said medial section of said frame.

10. The assembly of claim 1, further including a back pad removably coupled to an upper surface of said support member.

11. The assembly of claim 10, further including said back pad being positioned proximate a junction between said top portion of said support member and said medial portion of said support member.

12. The assembly of claim 1, further including a neck pad removably coupled to an upper surface of said support member.

13. The assembly of claim 12, further including said neck pad being positioned proximate said headrest.

14. The assembly of claim 1, further including a leg pad removably coupled to an upper surface of said support member.

15. The assembly of claim 14, further including said leg pad being positioned proximate a junction between said bottom portion of said support member and said medial portion of said support member.

16. A lounge chair assembly comprising:

a frame having a top section, a bottom section, and a medial section coupled to and extending between said top section and said bottom section;

a support member coupled to said frame, said support member being configured for supporting a person on said frame, said support member having a top portion coupled to said top section of said frame, a bottom portion coupled to said bottom section of said frame, and a medial portion coupled to said medial section of said frame;

a plurality of legs coupled to said frame, said plurality of legs having a pair of main legs pivotally coupled to said medial section of said frame, said main legs being configured for supporting said medial section of said frame over a support surface, said plurality of legs including a supplemental leg pivotally coupled to said bottom section of said frame, said supplemental leg selectively supporting said bottom section of said frame over a support surface;

a headrest telescopically coupled to said frame, said headrest extending from said top section of said frame;

an aperture extending through said head rest;

a pair of openings extending through said bottom portion of said support member, said openings each being configured for receiving a human foot therethrough whereby a leg extending from the foot is abutted and supported by said support member without bending of the foot relative to the leg;

a pocket coupled to a bottom surface of said support member, said pocket being coupled to a medial portion of said support member coupled to said medial section of said frame;

a strap having a first end coupled to said medial section of said frame and a second end coupled to said medial section of said frame, said strap being configured for facilitating carrying of said frame;

a frame extension coupled to and extending outwardly from a proximal edge of said medial section of said frame relative to said top section, said frame extension supporting said top section in a coplanar position relative to said medial section of said frame;

a bar coupled to said top section of said frame;

a plurality of hooks positioned along a length of said bar, each said hook being selectively couplable to said frame extension whereby said top section is supported in a raised position relative to said medial section of said frame;

a back pad removably coupled to an upper surface of said support member, said back pad being positioned proximate a junction between said top portion of said support member and said medial portion of said support member;

a neck pad removably coupled to an upper surface of said support member, said neck pad being positioned proximate said headrest;

a leg pad removably coupled to an upper surface of said support member, said leg pad being positioned proximate a junction between said bottom portion of said support member and said medial portion of said support member;

a pair of upper arm rests coupled to said medial section of said frame; and a pair of lower arm rests coupled to and extending downwardly from said top section of said frame and towards said headrest away from said medial section of said frame whereby each said lower arm rest is configured for supporting a forearm positioned on said lower arm rest while a face is positioned in said aperture in said headrest.

* * * * *